US006027320A

United States Patent [19]

Hendrix et al.

[11] Patent Number: 6,027,320

[45] Date of Patent: Feb. 22, 2000

[54] FLUID COMPRESSOR WITH MOVABLE HOSE REEL ASSEMBLY

[75] Inventors: Dean P. Hendrix, Mocksville; David F. Rowe, Jr., Advance; Donald G. Smith, Mocksville; William G. Keaton, Yadkinville, all of N.C.

[73] Assignee: Ingersoll-Rand Company, Woodcliff Lake, N.J.

[21] Appl. No.: 09/028,967

[22] Filed: Feb. 24, 1998

Related U.S. Application Data

[60] Provisional application No. 60/057,489, Sep. 4, 1997.

[51] Int. Cl.[7] ..... F09B 39/10

[52] U.S. Cl. ..... 417/572; 248/79; 239/195; 137/355.26

[58] Field of Search ..... 417/234, 313, 417/577; 248/79, 82; 239/195, 197; 137/355.12, 355.26

[56] References Cited

U.S. PATENT DOCUMENTS

| | | | |
|---|---|---|---|
| 4,050,858 | 9/1977 | Ewbank et al. | 417/234 |
| 4,719,991 | 1/1988 | Diehn et al. | 417/572 |
| 5,143,392 | 9/1992 | Collins | 280/420 |
| 5,636,648 | 6/1997 | O'Brien et al. | 134/107 |
| 5,678,599 | 10/1997 | Moss | 137/377 |

*Primary Examiner*—Charles G. Freay
*Attorney, Agent, or Firm*—Michael M. Gnibus

[57] ABSTRACT

A fluid compressor comprising a compression module for producing a compressed fluid, said compression module being enclosed in a compressor housing having a first side; and a hose reel assembly movably attached to the compressor housing, the hose reel assembly movable between a first position where the hose reel is adjacent the first side of the compressor housing and a second position wherein the hose reel assembly is located away from the first compressor housing side. The hose reel assembly may be moved to the second position away from the first housing side by swinging the hose reel assembly up away from the first side or pivoting the hose reel assembly to the side of the compressor.

18 Claims, 5 Drawing Sheets

FLUID COMPRESSOR WITH MOVABLE HOSE REEL ASSEMBLY

This application claims benefit of provisional application Ser. No. 60/057,489 filed Sep. 4, 1997.

BACKGROUND OF THE INVENTION

The invention relates to a fluid compressor having a reel for storing a length of hose for supplying a compressed fluid such as air to an object of interest such as a pneumatic tool, and more particularly the invention relates to a fluid compressor having a hose reel that is movable from a first position where the hose reel is located proximate one side of the fluid compressor housing to a second position where the hose reel is located away from the one side of the compressor housing.

Hose reels are mounted on truck-mounted air compressors for easy and convenient storage of lengths of air hose. The hose reels are usually fixed either to an end of the compressor housing, the top of the compressor housing, or on the truck bed. The fixed mounting location and orientation of the hose reel are selected after determining the typical position and orientation of the truck at a work site where compressed air is to be supplied.

Conventional hose reels are mounted and oriented to be able to easily supply compressed air at the majority of the job sites requiring pressurized air. However, once the hose reel is fixed to the compressor or truck bed it can not be relocated. As a result, frequently, it is difficult to connect the hose to the object of interest because the hose reel is often fixed in a location and orientation that are inconvenient relative to where the work requiring the compressed air is to be performed. For example, the hose reel may be located on the curb side of the truck while the work is to be performed on the opposite side of the street away from the curb. In such a situation, in order to supply the hose to the opposite side of the street, work must be stopped and the hose must be rerouted across the street. The rerouted hose is passed across the street, and may not be sufficiently long to reach the work site and also may be punctured by machinery at the site as the machinery travels over the hose.

There are several problems associated with mounting hose reels in fixed locations on the end of the compressor, roof of the compressor, and bed of the truck. When the hose reel is fixed to the roof of the compressor, the overall height of the compressor is increased and as a result, the hose reel can interfere with overhead storage racks on the trucks. It is also difficult to reach the hose reel because of its distance above the ground. Hose reels fixed on the bed of the truck take up of valuable cargo space on the truck bed, and also interfere with removal of the air compressor from the truck bed for service and repair because plumbing from the compressor to the hose reel must be disconnected before servicing and then reconnected after the compressor is serviced. When hose reels are rigidly mounted to an end of the compressor housing, the rigidly mounted hose reels block access to the interior of the compressor and must be removed before the compressor can be serviced, making servicing the compressor difficult.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid compressor including a compression module for producing a compressed fluid, where the compression module is enclosed in a compressor housing having a first side; and a hose reel assembly movably attached to the compressor housing, the hose reel assembly movable between a first position where the hose reel is adjacent the first side of the compressor housing and a second position wherein the hose reel assembly is located away from the first compressor housing side.

The foregoing and other aspects will become apparent from the following detailed description of the invention when considered in conjunction with the accompanying drawing figures.

DESCRIPTION OF THE DRAWING FIGURES

DESCRIPTION OF THE PREFERRED EMBODIMENT

Figure 1:
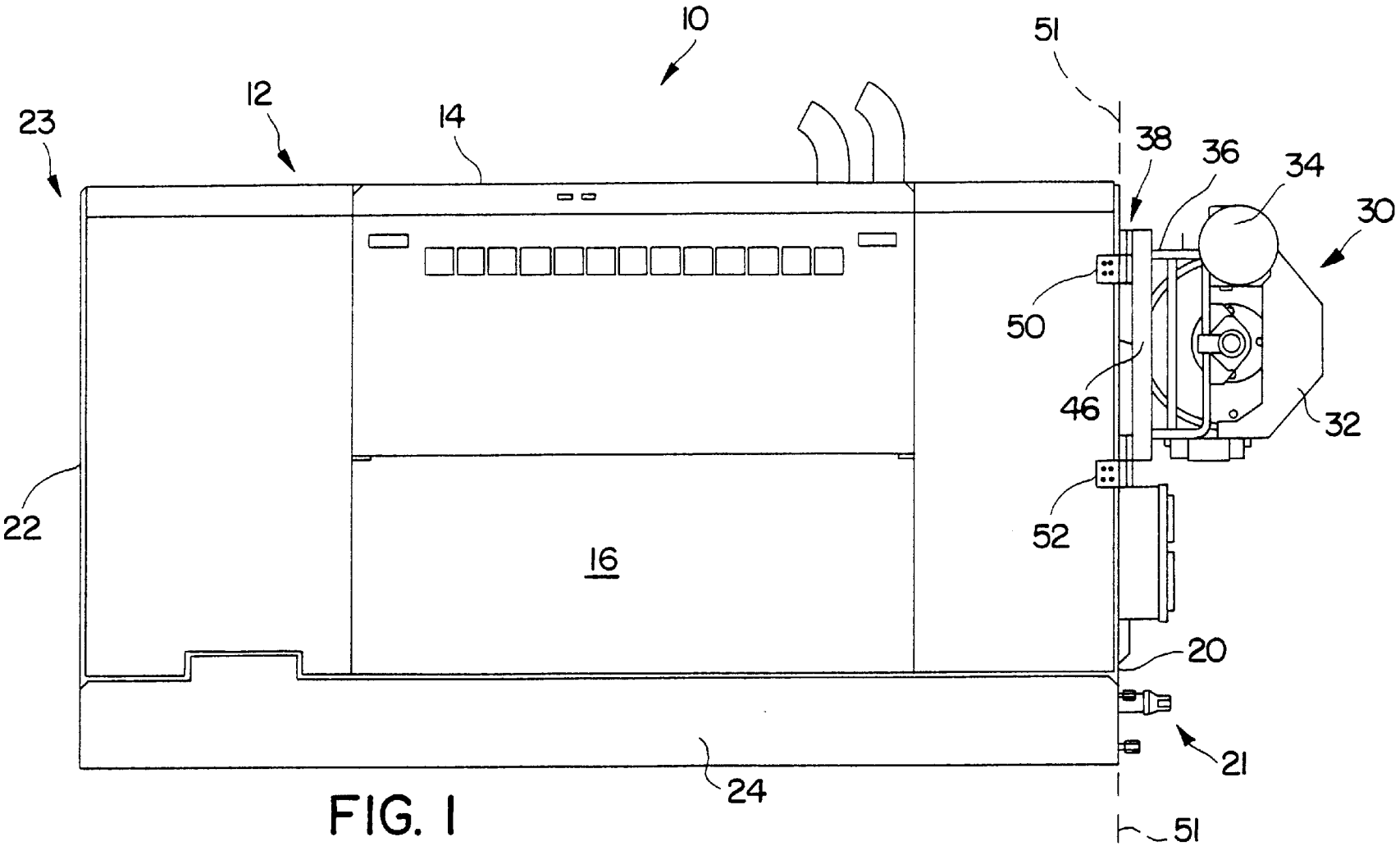
FIG. 1 is a front view of a first embodiment fluid compressor that includes the movable hose reel assembly of the present invention in a first position, in front of one side of the fluid compressor housing.
Figure 2:
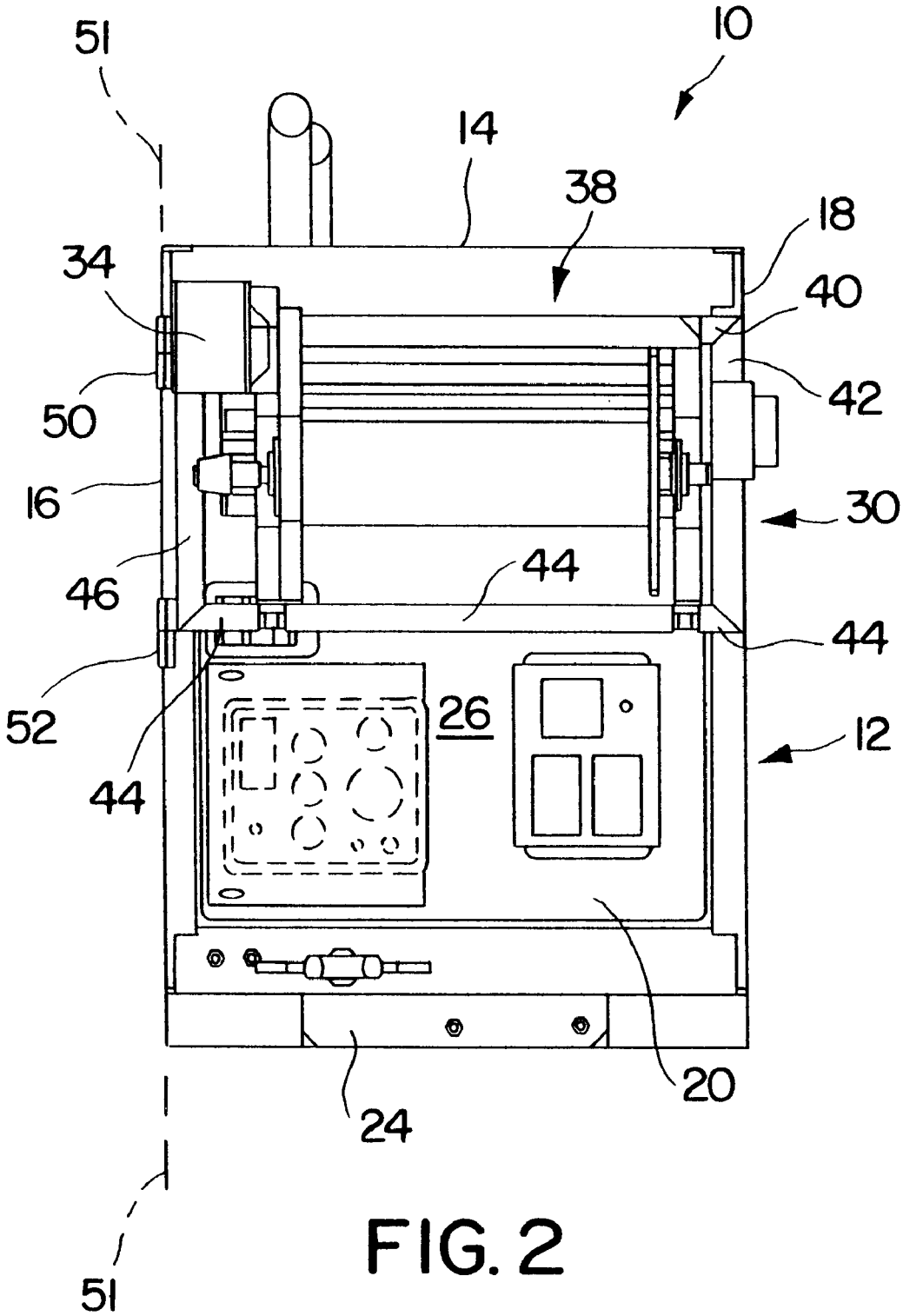
FIG. 2 is a right side view of the first embodiment fluid compressor of FIG. 1, showing the hose reel assembly in the first position.
Figure 3:
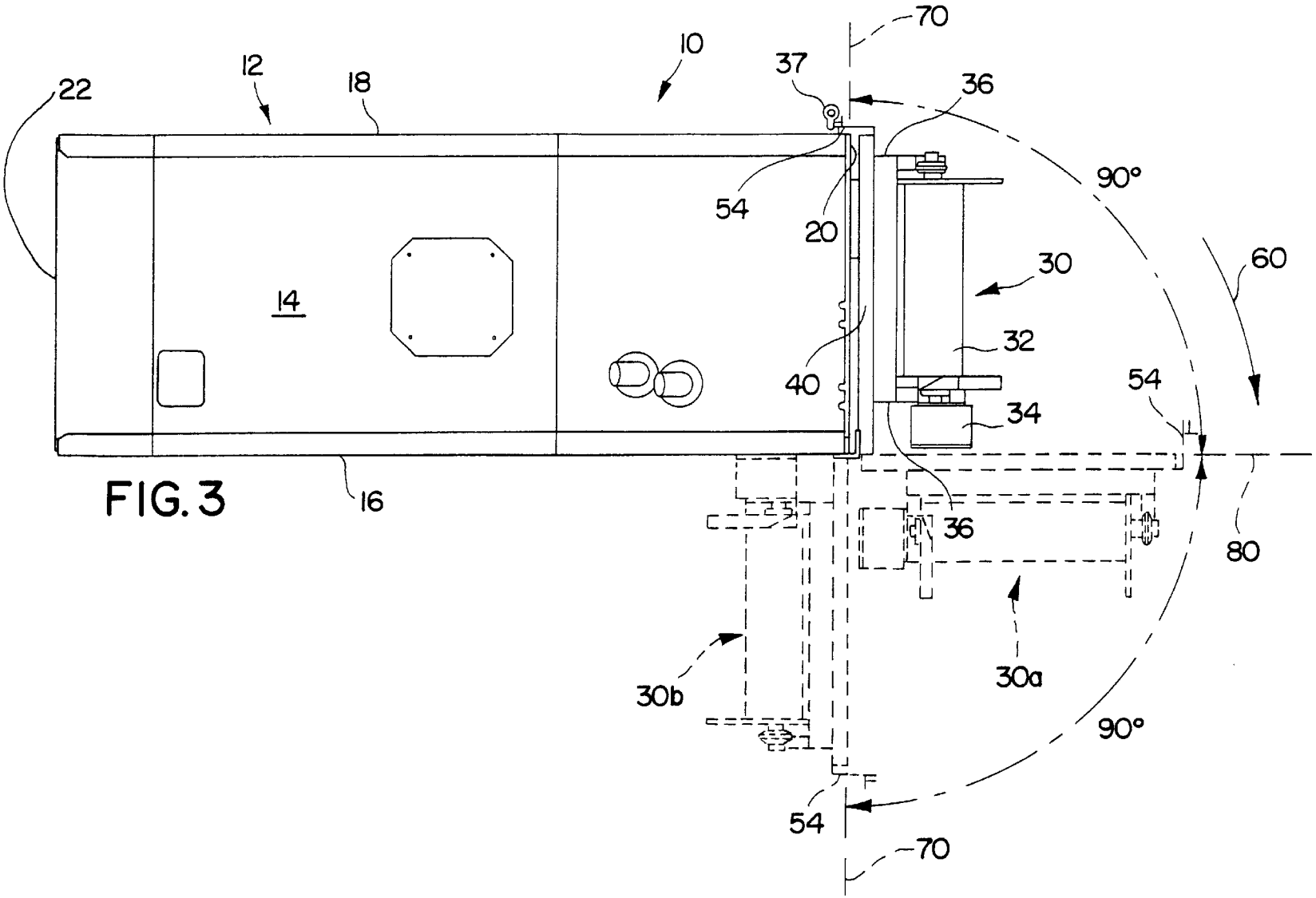
FIG. 3 is a top view of the first embodiment fluid compressor of FIG. 1 showing the movement of the hose reel assembly relative to the compressor housing with the first hose reel position shown in solid lines and the movement of the hose reel assembly represented in dashed font.

Turning now to the drawings wherein like parts are referred to by the same number throughout the several views, and particularly FIG. 1, first embodiment fluid compressor 10 includes a conventional compression module (not shown) for supplying a compressed fluid such as air, and the compression module preferably includes a rotary screw airend driven by a prime mover such as a diesel engine or electric motor. The compression module is conventional and well known to one skilled in the art and therefore, additional detailed description of the compression module is not required. Neither the prime mover nor the airend are shown in FIGS. 1–3 which illustrate the first embodiment fluid compressor 10. The fluid compressor 10 is generally referred to by those skilled in the art as a "utility compressor" which is usually mounted on a truck bed and transported by truck to job sites where compressed air is required to actuate pneumatic devices.

The compression module is enclosed by a compressor housing 12. In the first preferred embodiment of the invention, the housing is five-sided and includes top side 14, first longitudinal side 16, second longitudinal side 18, first lateral side 20 at housing end 21, and second lateral side 22 at housing end 23. The sides may be bolted or otherwise fastened together in a conventional manner to form the housing and enclose the compression module. A service door 26 is provided in first lateral side 20 and the service door permits a compressor operator to gain access to the interior of the housing to provide maintenance or other service to the compression module or other compressor components such as filters for example.

The compression module and housing are supported by base 24 which in turn may be located on a truck bed, trailer or another movable platform for transporting fluid compressor 10 between designated job sites.

A movable hose reel assembly 30 is provided at first housing lateral end 21 in front of housing side 20. Hose used to supply compressed air produced by the compression module to an object of interest, is wound on reel 32. The hose is not shown in the description of the first preferred embodiment but may be any suitable conventional hose for delivering pressurized air. The hose is wound up on the reel by a motor 34 which conventionally rotates the drum of reel 32. The hose reel assembly 30 is supported by support frame 36 which in turn is fixed to rigid frame 38 by a bolt attachment or other suitable attachment means well known to one skilled in the art.

As shown most clearly in FIG. 2, the rigid frame 38 is rectangular and includes first, second, third and fourth frame members 40, 42, 44, and 46 that are made integral by weld connections between adjacent frame members.

The frame is movably attached to housing longitudinal side 16 by hinges 50 and 52 which define axis 51. As shown in FIGS. 1 and 3, one hinge plate of each hinge 50, 52 is attached to housing side 16 and the other hinge plate is attached to fourth frame member 46. The hinges 50 and 52 permit the hose reel assembly to be movable between a first position where the hose reel assembly is in front of the compressor housing side 20, to a second position where the hose reel assembly is located away from the housing side 20. The hose reel assembly is rotatable about axis 51. As shown in dashed font in FIG. 3, the assembly 30 may be rotated about the axis 51, clockwise in the direction of arrow 60, ninety degrees as illustrated by assembly 30*a*, or an additional ninety degrees (180 degrees total), as illustrated by assembly 30*b*. But generally, the second position is separated from the first position by at least 90 degrees. The compressor housing side 20 defines a plane 70 and the frame 38 defines a plane 80, and when the assembly is moved to the second position, the planes 70 and 80 are separated by at least 90 degrees as shown in FIG. 3.

An L-shaped latch member 54 is made integral with second frame member 42. When the assembly 30 is in the first position, the latch, in combination with a spring biased retention member 37 maintains the assembly in the first position. The latch is adapted to receive the rigid retention member which is supported by the housing side 18.

By movably attaching the hose reel assembly to the compressor housing side 16, the hose reel assembly can be easily moved away from the first position in front of service door 26 and housing side 20 to permit access to the door and interior of the compressor housing. Since the hose reel assembly is movably mounted to the end of compressor housing 12 storage space is not consumed by the hose reel assembly since it is not necessary to rigidly mount the hose on the top side of the compressor housing in order to preserve truck storage space; and if it is necessary to move the hose to the opposite side of the vehicle, the hose reel assembly can simply be rotated about axis 51, 180 degrees to move the hose to the required location. In summary, problems associated with rigidly mounting the hose reel assembly to the truck bed or compressor housing are eliminated by the novel arrangement of the present invention.

Figure 4:
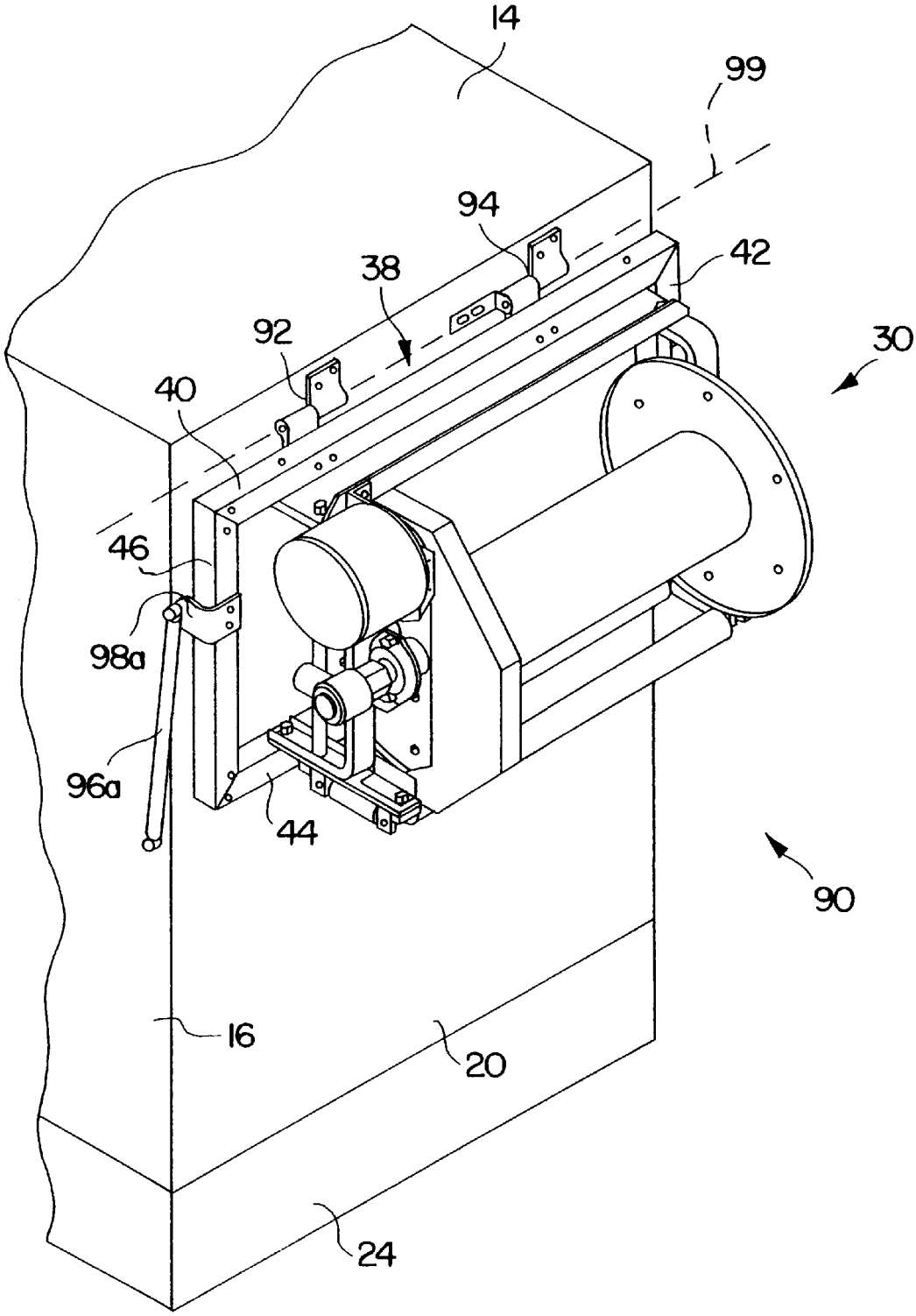
FIG. 4 is an isometric view of a portion of second embodiment fluid compressor that includes the movable hose reel assembly of the present invention in a first position in front of one side of the fluid compressor housing.
Figure 5:
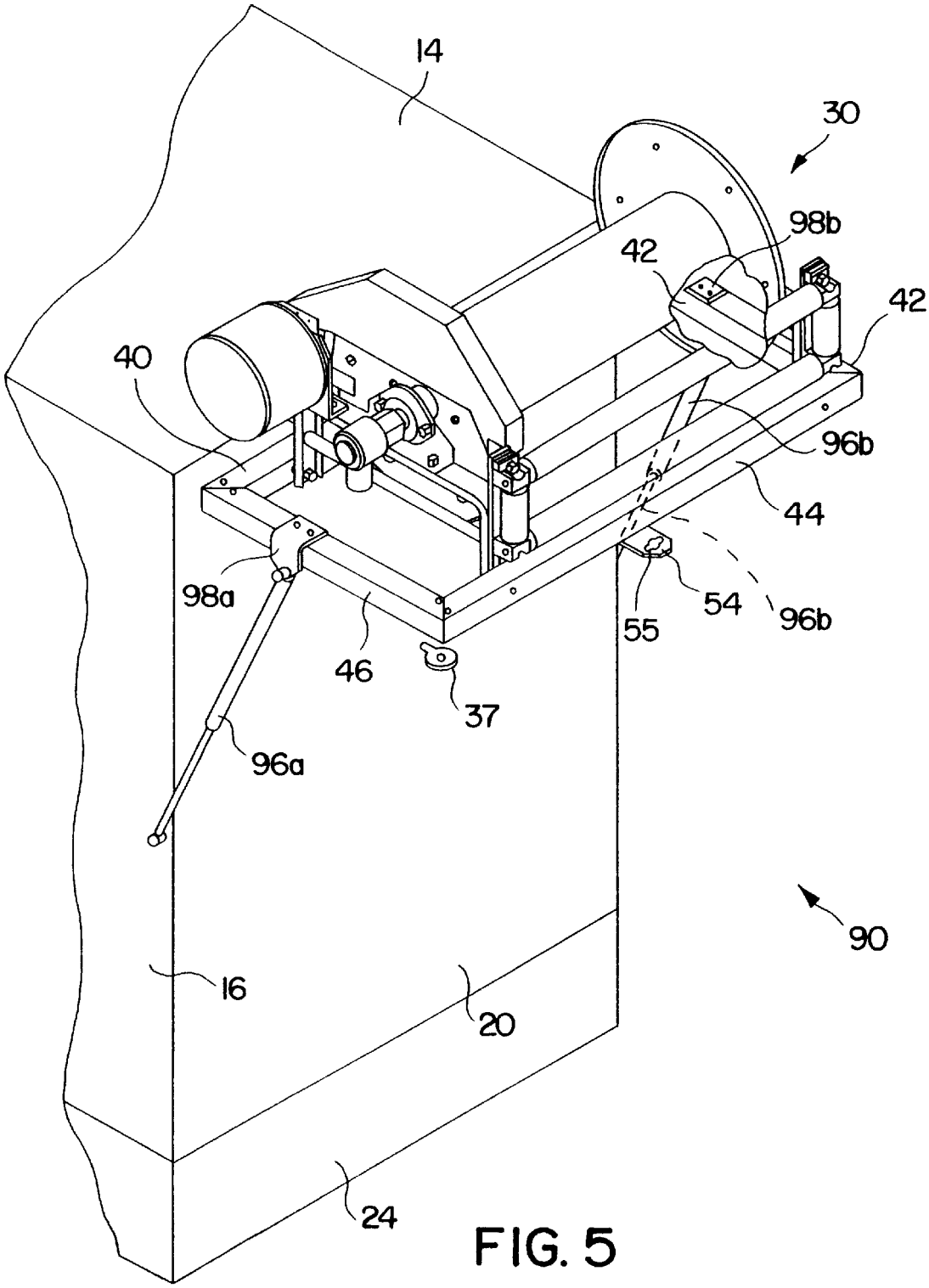
FIG. 5 is the isometric view of FIG. 4 showing the hose reel assembly in a second position.

FIGS. 4 and 5 illustrate a second embodiment fluid compressor 90 with movable hose reel assembly 30.

The second embodiment fluid compressor includes the compressor housing 12, compression module, and hose reel assembly 30 of the first embodiment fluid compressor 10. Additionally, the second embodiment fluid compressor includes hinges 92 and 94 which define axis 99, and support means 96*a* and 96*b* which support the hose reel assembly in the second position shown in FIG. 5.

The hose reel assembly 30 is movably attached to compressor housing side 20 by hinges 92 and 94 to be rotatable about axis 99. One plate of hinges 92 and 94 is attached to frame member 40 and a second hinge plate is attached to housing side 20 near top housing side 14, as shown in FIG. 4. Like hinges 50 and 52, hinges 92 and 94 are of conventional design and are attached to the frame and housing side 20 by conventional fastener means such as bolts. By the hinge connection, the hose reel assembly is movable between the first position shown in FIG. 4 where the planes 70, and 80 of frame 38 and housing side 20 are substantially parallel, and the second position shown in FIG. 5 where the planes of the frame and housing side 20 are separated by at least ninety degrees.

As the hose reel assembly is moved to the second position, support means 96*a* and 96*b* extend to support the assembly 30. It is preferred that the support means 96*a* and 96*b* are conventional gas springs with a first end fixed to respective housing sides 16 and 18 and second end fixed to L-shaped brackets 98*a* and 98*b* which in turn are secured to frame members 46 and 42. See FIG. 5.

Latch member 54 is connected to frame member 44 and serves to hold the hose reel assembly in place when it is in the first position, of FIG. 4. The latch includes an opening 55 that is adapted to receive a spring loaded securing member 37 that is passed through opening 55 and an opening provided in housing side 20.

Although not showing in detail in FIGS. 4 and 5, first housing side 20 includes service door 26 and the controls and guages shown in FIGS. 1–3 of first embodiment compressor 10.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

Having described the invention, what is claimed is:

1. A fluid compressor comprising:

a) a compression module for producing a compressed fluid, said compression module being enclosed in a compressor housing having a first side; and b) a hose reel assembly movably attached to the compressor housing, the hose reel assembly movable between a first position where the hose reel is adjacent the first side of the compressor housing and a second position wherein the hose reel assembly is located away from the first compressor housing side.

2. The fluid compressor as claimed in claim 1 wherein the compressor housing includes a second housing side, the hose reel assembly being attached to the second compressor housing side.

3. The fluid compressor as claimed in claim 2 wherein the second compressor housing side is a longitudinal side of the housing.

4. The fluid compressor as claimed in claim 1 wherein the hose reel assembly is attached to the first housing side.

5. The fluid compressor as claimed in claim 1 wherein the hose reel assembly is attached to the housing by a hinge means for attachment.

6. The fluid compressor as claimed in claim 5 wherein the hose reel assembly is comprised of a reel fixed to a frame, the hinge means attaching the frame and compressor housing.

7. The fluid compressor as claimed in claim 1 wherein the first housing side is located at the end of the housing, the hose reel assembly being in front of the first housing side when the hose reel assembly is in the first position.

8. The fluid compressor as claimed in claim 1, the first housing side defining a first plane, the hose reel assembly comprising a reel, fixed to a frame, the frame being attached to the compressor housing, the frame further defining a second plane, the first and second planes being substantially parallel when the hose reel assembly is in the first position and the first and second planes being separated by at least ninety degrees when the hose reel assembly is in the second position.

9. The fluid compressor as claimed in claim 8 wherein the first and second planes are separated by 180 degrees.

10. The fluid compressor as claimed in claim 4 wherein the hose reel assembly is held in the second position by support means.

11. The fluid compressor as claimed in claim 10 wherein the hose reel assembly is supported by a pair of gas springs.

12. A fluid compressor comprising:

a) a compression module for producing a compressed fluid, said compression module being enclosed in a compressor housing having a first housing side and a second housing side; and b) a hose reel assembly comprising a frame and a reel fixed to the frame, the frame is attached to the housing side by hinge means and the hose reel assembly is movable between a first position where the hose reel is located in front of the first compressor housing side, and a second position wherein the hose reel assembly is located away from the first compressor housing side.

13. The fluid compressor as claimed in claim 12 wherein the frame is fixed to the second housing side, and wherein the first housing side is an end of the housing and the second housing side is a longitudinally extending side of the compressor housing.

14. The fluid compressor as claimed in claim 12 wherein the first housing side is an end of the housing and the frame is fixed to the first housing side.

15. The fluid compressor as claimed in claim 13 wherein the first and second hose reel assembly positions are separated by 180 degrees.

16. The fluid compressor as claimed in claim 14 wherein the first and second hose reel assembly positions are separated by 90 degrees.

17. The fluid compressor as claimed in claim 16, the fluid compressor further comprising support means for maintaining the hose reel assembly in the second position.

18. The fluid compressor as claimed in claim 17, the fluid compressor comprising a third housing side, and wherein the support means is comprised of a first gas spring joining the frame and the second compressor housing side and a second gas spring joining the frame and the third compressor housing side.

* * * * *